United States Patent [19]

Riffe et al.

[11] 4,030,058

[45] June 14, 1977

[54] INDUCTIVE COUPLER

[75] Inventors: Delmar R. Riffe, Murrysville; Richard D. Olson, Monroeville; David M. Edison, Murrysville; Robert J. Spreadbury, Franklin Township, Westmoreland County, all of Pa.

[73] Assignee: Westinghouse Electric Corporation, Pittsburgh, Pa.

[22] Filed: Mar. 30, 1976

[21] Appl. No.: 671,852

[52] U.S. Cl. ..... 336/92; 204/196; 336/96; 336/DIG. 2

[51] Int. Cl.[2] ..... H01F 27/02

[58] Field of Search ..... 336/DIG. 2, 92, 96; 320/2; 174/17 R; 204/196

[56] References Cited

UNITED STATES PATENTS

| | | | |
|---|---|---|---|
| 2,374,662 | 5/1945 | Black | 336/DIG. 2 |
| 2,379,664 | 7/1945 | Stanko | 336/DIG. 2 |
| 3,277,358 | 10/1966 | Nicholl | 336/DIG. 2 |
| 3,387,606 | 6/1968 | Crafts et al. | 336/DIG. 2 |
| 3,549,990 | 12/1970 | Hochheiser | 336/DIG. 2 |
| 3,602,631 | 8/1971 | Sheppard | 174/17 R |
| 3,621,561 | 11/1971 | Higbee et al. | 174/17 R X |
| 3,772,625 | 11/1973 | Raupach | 336/DIG. 2 |

FOREIGN PATENTS OR APPLICATIONS

| | | | |
|---|---|---|---|
| 1,398,224 | 6/1975 | United Kingdom | 336/DIG. 2 |

*Primary Examiner*—Thomas J. Kozma
*Attorney, Agent, or Firm*—M. P. Lynch

[57] ABSTRACT

The primary and secondary core sections of a split core transformer forming an inductive coupler are secured within separate sealed containments in intimate contact with a thin non-magnetic portion of the respective containments which permits inductive coupling and decoupling of the primary and secondary core sections in corrosive fluid environments such as water. The sealed containments isolate the core sections from contact with the corrosive environment thus permitting the use of efficient laminated iron in otherwise corrosive environments.

1 Claim, 6 Drawing Figures

INDUCTIVE COUPLER

BACKGROUND OF THE INVENTION

The use of electrical equipment in corrosive environments, such as is associated with subsea well heads, necessitates the capability for connecting and disconnecting electrical power to such electrical equipment.

Although conventional type hermetic connectors are satisfactory for use in water providing the connections are made prior to immersing in the water, such conventional type hermetic connectors are not generally satisfactory for connecting and disconnecting electrical power underwater.

While transformer core sections have been suggested for use in constructing an electrical connector, such as described in the NASA Tech. Brief B73—10125, entitled "Electrical Connector", the prior art has failed to disclose a technique for successfully employing transformer technology to develop a reliable inductive coupler.

SUMMARY OF THE INVENTION

While the requirement for electrical disconnects exists in numerous corrosive environments and the inductive coupler disclosed herein has application in such environments, the underwater environment has been selected to disclose a preferred embodiment of an improved inductive coupler.

There is described herein with reference to the accompanying drawings, a two part, split-core type transformer suitable for inductive coupling and decoupling power lines in corrosive environments.

The primary windings and associated core comprising the primary core sections are secured within a first sealed containment while the secondary windings and cores comprising the secondary core sections are secured within a second sealed containment. The mechanical design of the containments is such that the two containments can be mechanically connected and disconnected in such a manner that the primary and secondary core sections are appropriately aligned to assure inductive coupling and decoupling.

An "air gap" consistent with magnetic circuit designs of conventional transformers is formed by the walls of the respective containments which are secured in intimate contact when the containments are mechanically connected.

In an embodiment where electrical power is to be delivered to electrical equipment associated with an underwater installation, an electrical connection is made between the electrical equipment and the windings of the secondary core section containment which is located with the equipment beneath the surface of the water. The windings of the primary core section containment are electrically connected to a power source located above the surface of the water. The primary core section containment is lowered into the water for inductive coupling with the secondary core section containment to provide the underwater capability of connecting and disconnecting electrical power to the equipment.

DESCRIPTION OF THE DRAWINGS

The invention will become more readily apparent from the following exemplary description in connection with the accompanying drawings.

DESCRIPTION OF THE PREFERRED EMBODIMENT

Figure 1A:
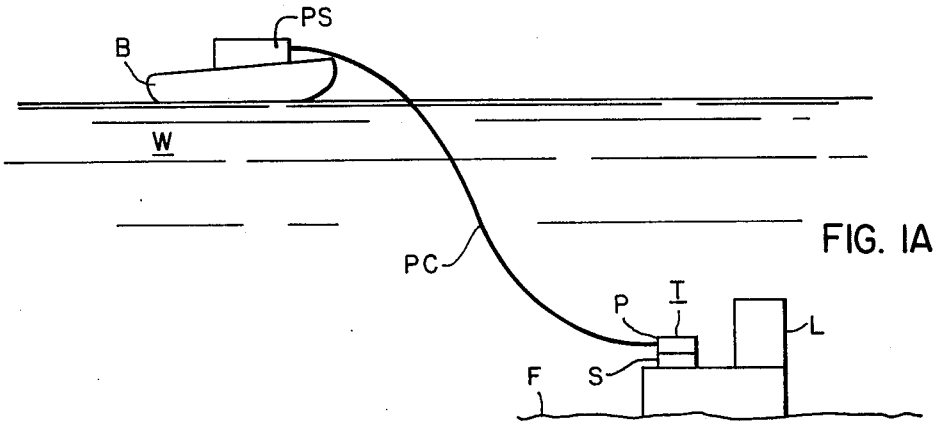
FIGS. 1A and 1B are pictorial representations of a subsea well head installation and an inductive coupler suitable for supplying electrical power from the surface to electrical equipment immersed beneath the surface of the water.
Figure 1B:
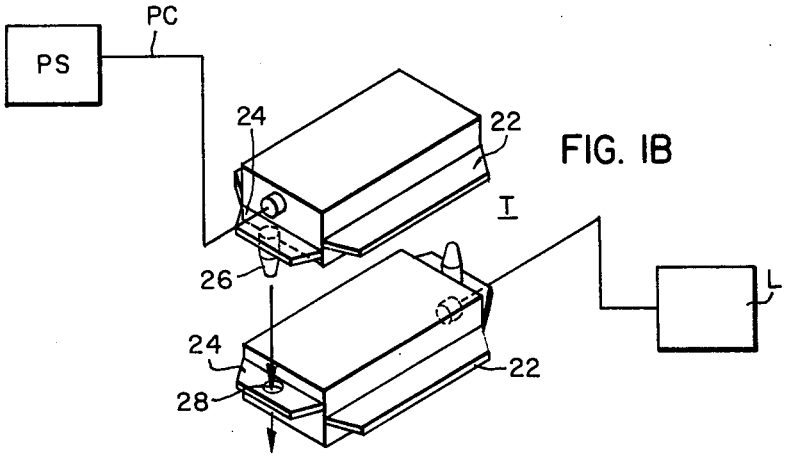

Referring to FIGS. 1A and 1B there is illustrated a subsea well head installation having a barge B floating on the surface of the water W and electrical drilling and control equipment L positioned on the floor F of the body of water. Electrical power is supplied to the control equipment L through an inductive coupler T consisting of a primary core section containment P electrically connected to a power source S located on the barge B and a secondary core section containment S directly connected to the control equipment L.

The primary core section containment P and the secondary core section containment S of FIGS. 1A and 1B form an inductive coupler suitable for connecting and disconnecting electrical power beneath the surface of the water in accordance with the structural details illustrated in FIGS. 2, 3 and 4A and 4B.

Figure 3:
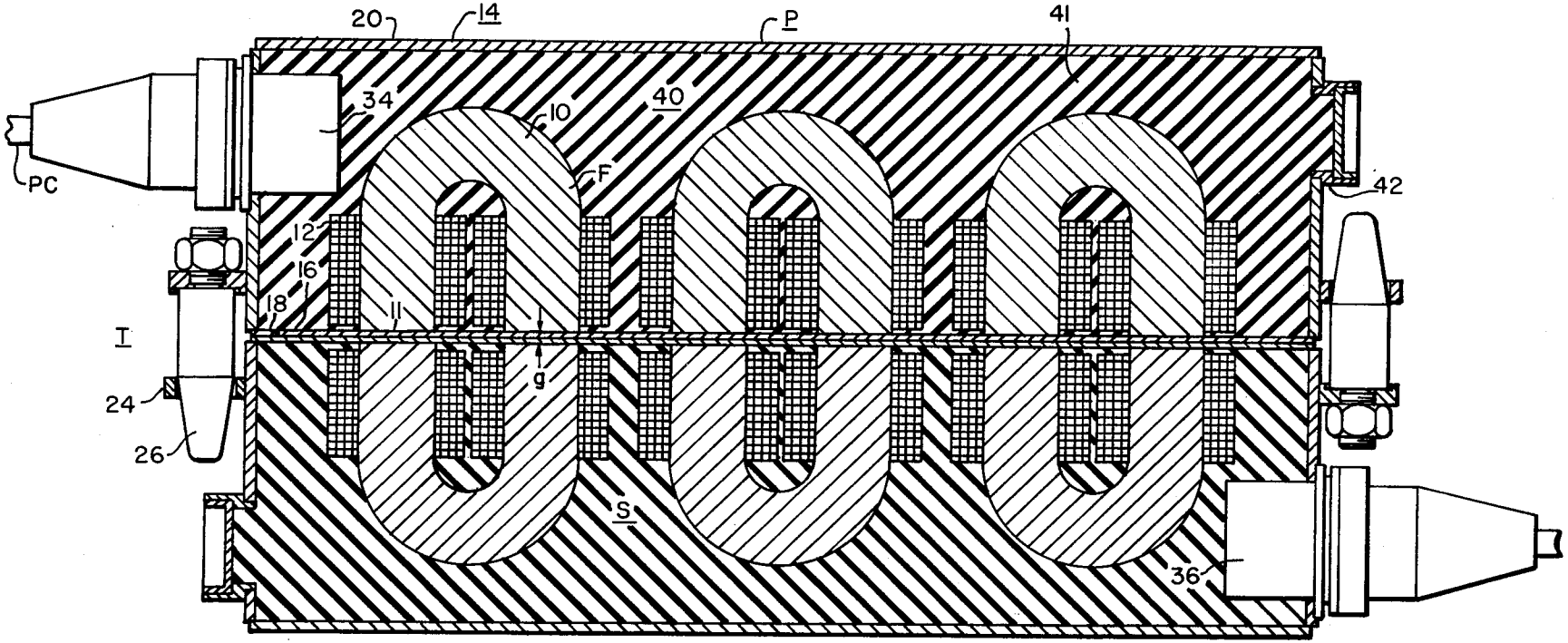
FIG. 3 is a sectioned illustration of an embodiment of the inductive coupler of FIG. 1.

The containments identified as the primary core section containment P and the secondary core section containment S are essentially identical as illustrated in FIG. 3. Conventional transformer core sections are totally enclosed within sealed housings constructed of material suitable for withstanding the corrosive effects of the operational environment typically illustrated herein as water.

While a three-phase transformer arrangement, represented by three core sections, has been chosen to illustrate the invention, it will be apparent from the following discussion that the disclosed techniques are equally suitable for constructing inductive couplers employing any number of transformer core sections. Further, since the technique for packaging the transformer core sections to produce a suitable inductive coupler in accordance with the invention apply identically to the primary core section containment P and the secondary core section containment S, the following discussion will be limited to the structural details of the primary core section containment P. This is not to say that the number of turns primary and secondary windings of the respective containments are identical but rather that the mechanical packaging of the components of the respective containments is identical so as to produce a symmetrical arrangement of core sections F in the respective containments to insure inductive coupling between the primary core section containment P and the secondary core section containment S when the respective containments are mechaniclly mated as illustrated in FIGS. 1 and 3.

The core sections F, which are herein illustrated as consisting of conventional C-core elements 10 and windings 12 are secured within a sealed housing 14 with the pole faces 11 in intimate contact with the internal surface 16 of the mating wall 18 of housing 14. The housing wall 18 of the respective containments P and S combine to form the required transformer air gap g between the inductively coupled containments when the containments P and S are mechanically mated in accordance with the illustrations of FIGS. 1 and 3.

While the remaining walls 20 of the housing 14 are of a thickness to provide necessary mechanical strength and of a material suitable for resisting corrosion in the water environment, the material for the mating walls 18 must not only exhibit significant corrosion resistance but must also be non-magnetic and of a relatively high electrical resistivity to suitably function as the required air gap g between the inductively coupled core sections F of the containments P and S respectively. The width of the air gap is maintained at a value consistent with magnetic circuit design criteria of conventional transformers to minimize losses due to leakage reactance. Detailed studies have shown an air gap g in the range of about 0.004 to 0.020 inches, corresponding to a mating wall 18 thickness of between 0.002 and 0.010 provides efficient coupling of power between the containments P and S.

While the disclosed technique for producing an inductive coupler applies to both the coupling of low power transmission signals and high power supply voltage, the fact that the core sections F are totally enclosed within a sealed containment, thus isolating the core materials from the corrosive environment, permits the use of efficient core material, such as laminated iron, which is particularly suitable in the fabrication of high power inductive couplers.

Stainless steel, with its inherent corrosion resistance characteristics, has proven to be useful not only for the housing walls 20, but also suitable as an air gap material for mating walls 18. In addition to stainless steel, materials such as titanium and the commercially available alloys, such as the zirconium-aluminum alloy Zircalloy, likewise have the non-magnetic, corrosion resistance, and high electrical resistivity characteristics which render these materials suitable to complete the magnetic circuit between corresponding core sections F of mated containments P and S.

The corrosion resistance characteristics of the housing 14 can be further improved by the addition of a "sacrificial anode" 22 of a material composition, which is selected to exhibit less resistance to corrosion in the operational environment than the material selected for the housing 14 and thus effectively attracts the corrosion producing elements in the environment thus reducing the concentration of corrosion producing elements contacting the housing 14. In the water environment, carbon steel represents a suitable material for anode 22 in combination with a stainless steel housing 14.

A major source of corrosion in the underwater environment is caused by the electrolytic effect produced between dissimilar metals represented by the mating brackets 24 and the housing 14. The material for the sacrificial anode 22 is selected to promote an electrolytic relationship between the mating brackets 22 and the sacrificial anode 22 and discourage an electrolytic relationship involving the housing 14.

An additional problem encountered in underwater environments is the accomulation of marine growth on the mating walls 18 of the housing 14 when the containments P and S are not mechanically mated.

One solution of this problem involves the application of a toxic marine paint or coating to the surface of the mating walls 18.

A more permanent solution, which has been tested successfully, involves the use of an anti-fouling rubber as the mating wall 18 in place of the previously disclosed metal. A particularly suitable rubber material which has effectively supported inductive coupling of the containments P and S is the commercially available B. F. Goodrich product identified as No Foul rubber sheeting. Thickness of the rubber sheeting which provides an air gap g in the range between 0.004 and 0.020 inches have proven successful.

The containments P and S are maintained in a mechanically aligned secured relationship by the mating brackets 24. The mating brackets 24 include an alignment mechanism corresponding to an arrangement of alignment pins 26 and female receptacles 28 which assure appropriate mechanical alignment of the containments P and S during mechanical mating.

The winding 12 of the core sections F of the primary core section containment P are connected to a sealed multi-pin bulkhead connector 34 which is welded in a wall of the containment P for connection to power cables PC. Similarly, a sealed multi-pin bulkhead connector 36 is welded in a housing wall of the secondary core section containment S to provide electrical connection between the windings of the secondary core sections and the control equipment L.

During the assembly of the containments P and S, it is essential that the pole faces of the C-core elements be maintained in intimate contact with the internal surface 16 of the respective housing walls 18, and the core sections F be maintained in a fixed position within the housing 14 so as to assure proper alignment and inductive coupling between the corresponding core sections of the containments P and S. This is achieved in the embodiment of FIG. 3 by filling the volume 40 defined by the housing 14 with a composition 41, such as an epoxy, which exhibits the desired thermal expansion characteristics as well as mechanical strength sufficient to maintain the integrity of the relatively thin mating walls 18 under the pressures encountered in underwater installations. Suitable compositions for filling the volume 40 are commercially available. The filling of the volume 40 is accomplished through a fill port 42. While the filling of the volume may be accomplished under atmospheric pressure conditions, optimum filling of the volume 40 is realized when a vacuum or near vacuum is drawn in the volume 40 via the fill port 42 and the volume subsequently filled under near vacuum conditions. Vacuum filling minimizes the presence of air pockets in the composition-filled volume 42. Problems encountered in maintaining the core sections F in fixed positions during the filling operation can be eliminated by first bonding the pole face 11 of the C-core elements 10 to the internal surface 16 of the mating walls 18 using a bonding material which is compatible with the composition used to fill the volume 42. Thus, the fill composition not only maintains the core sections F in preset contacting relationship with the internal surface 16 of the mating walls 18 of the containments P and S, but further provides mechanical support necessary for the relatively thin mating walls 18 in order to withstand the pressures encountered at depths of up to 3,000 feet.

Figure 4A:
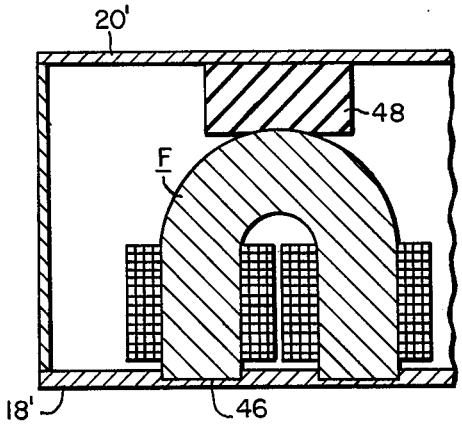
FIGS. 4A and 4B are illustrations of alternate embodiments of the inductive coupler of FIG. 3.
Figure 4B:
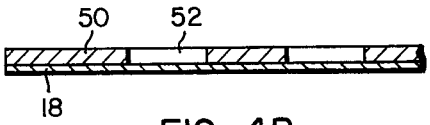
Figure 2:
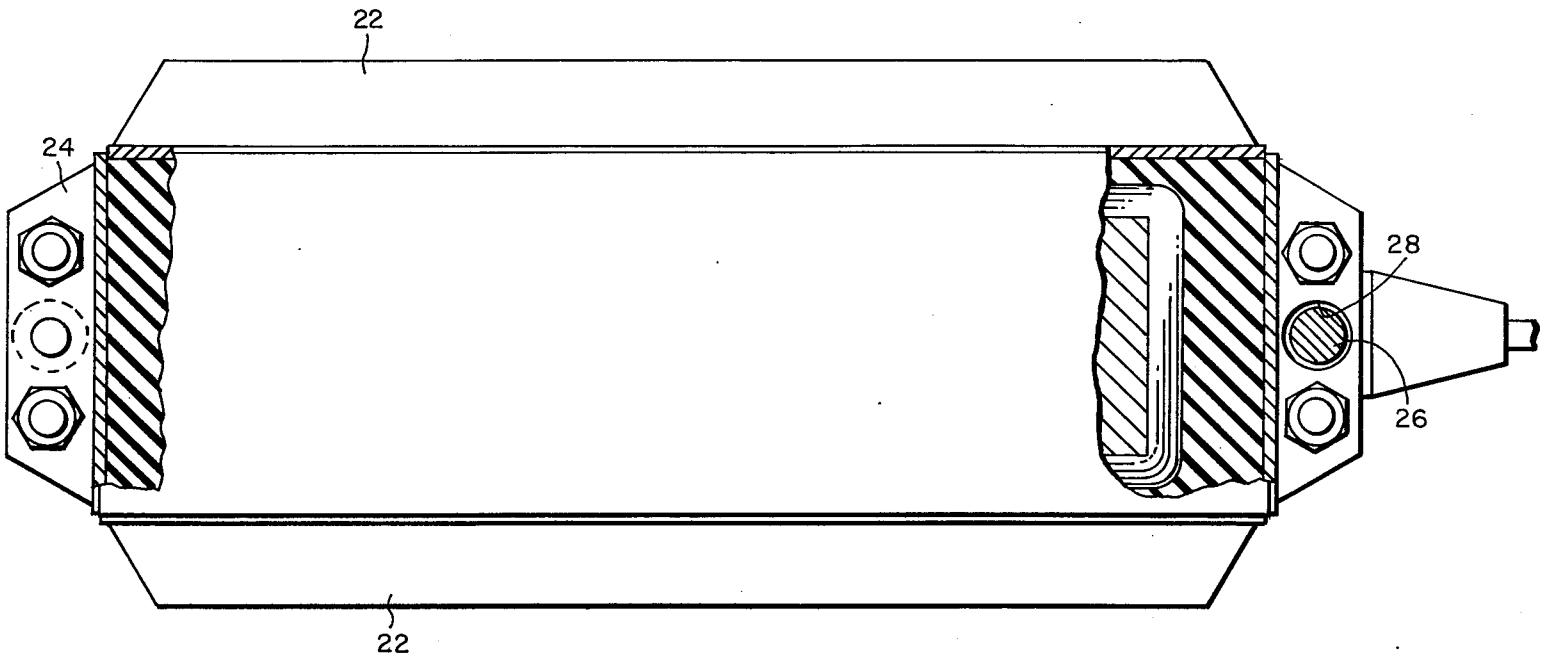
FIG. 2 is a top view of the inductive coupler of FIG. 1.

There is illustrated in FIGS. 4A and 4B a variation in the housing wall 18 wherein the minimum thickness corresponding to the air gap g is limiting to a portion 46 of the mating wall 18′ contacted by the pole faces 11 of the C-core elements 10. The remainder of the mating wall 18' of FIG. 4A is of a thickness corresponding to the thickness of the housing walls 20 of FIG. 3 thus eliminating the need for filling the volume 42 for the purposes of providing mechanical support to the mating wall 18. Deformation of the air gap portion 46 of the mating walls 18' of FIG. 4A can be eliminated by maintaining the C-core element 10 in mechanical contact with the air gap portion 46 by positioning a resilient shim 48 of plastic or rubber, under compression, between the housing wall 20' and the C-core element 10 as shown in FIG. 4A. While the filling of volume 42 is not required to provide mechanical support in FIG. 4A, the filling of volume 42 can eliminate the need for the resilient shim 48.

The mating wall 18' of FIG. 4A can be produced by chemically etching or mechanically broaching a relatively thick mating wall 18' specimen to produce the air gap portion 46 or, as illustrated in FIG. 4B, the mating wall 18 of FIG. 3 can be bonded to a relatively thick mechanical backup plate 50 having apertures 52 therein to accommodate the C-core elements 10.

We claim:

1. An inductive coupler apparatus for connecting and disconnecting electrical power in an underwater environment, comprising:

first and second water-tight sealed stainless steel housings adapted for mechanical mating and each including a stainless steel mating wall having internal and external surfaces, each of said stainless steel mating walls being of a thickness between 0.002 and about 0.010 inches, mechanical alignment means extending from said water-tight sealed stainless steel housing for mechanically aligning said first and second water-tight sealed stainless steel housing during mating in an underwater environment, said external surfaces of said stainless steel mating walls being aligned in intimate contact when said first and second water-tight sealed stainless steel housings are mechanically mated, sacrificial anode means extending from at least one of said first and second water-tight sealed stainless steel housings to minimize corrosion of said housings in an underwater environment, at least one primary transformer core section including a C-core element and corresponding pole faces and primary coil windings thereabout, said primary transformer core section being positioned within said first water-tight sealed stainless steel housing with said pole faces in ultimate contact with the internal surface of the stainless steel mating wall of said first water-tight sealed stainless steel housing, at least one secondary transformer core section including a C-core element and corresponding pole faces and secondary coil windings thereabout, said secondary transformer core section being positioned within said second water-tight sealed housing with said pole faces in intimate contact with the internal surface of the stainless steel mating wall of said second water-tight sealed stainless steel housing, said primary and secondary transformer core sections being positioned such that the pole faces of the respective core sections are physically aligned when said first and second water-tight sealed stainless steel housings are mechanically mated to thereby complete a magnetic circuit between said primary transformer core section and said secondary transformer core section, and fill composition filling the internal volumes of said first and second water-tight sealed stainless steel housings to provide mechanical support to enable the stainless steel mating walls to withstand the external pressure of an underwater environment.

* * * * *